United States Patent [19]

Arias Mas

[11] Patent Number: 4,512,160

[45] Date of Patent: Apr. 23, 1985

[54] MACHINE FOR MAKING ICE FLAKES FROM SEA WATER OR FRESH WATER

[76] Inventor: Gonzalo Arias Mas, Nunez de Balboa 31, Madrid, Spain

[21] Appl. No.: 455,034

[22] Filed: Dec. 21, 1982

[30] Foreign Application Priority Data

Dec. 21, 1981 [ES] Spain ..... 508.206
Nov. 29, 1982 [ES] Spain ..... 517.788

[51] Int. Cl.[3] ..... F25C 7/12

[52] U.S. Cl. ..... 62/71; 62/74; 62/346; 62/347

[58] Field of Search ..... 62/532, 544, 545, 66, 62/71, 74, 346, 347; 203/DIG. 17; 165/91

[56] References Cited

U.S. PATENT DOCUMENTS

| | | | |
|---|---|---|---|
| 491,104 | 2/1893 | Hart | 62/346 |
| 1,931,347 | 10/1933 | Gay | 62/545 |
| 3,494,144 | 2/1970 | Schill | 62/346 |

*Primary Examiner*—Frank Sever
*Attorney, Agent, or Firm*—Young & Thompson

[57] ABSTRACT

A machine for making ice flakes by freezing sea or fresh water, comprises a fixed central core and a plurality of fixed pipes surrounding the core for containing a circulating refrigerant. A hollow rotatable cylindrical drum coaxial with the core surrounds the pipes; and an anti-freeze liquid freezing lower than water substantially fills the space between the core and the drum. A spray manifold for water to be frozen extends horizontally full length of the drum and feeds a horizontal series of spaced spray nozzles that spray the water on the drum. The sprayed water then moves downwardly with the drum and then upwardly and then downwardly again; but before reaching the region of the nozzles, that is, shortly before completing one full revolution, a knife that rides on the surface of the drum scrapes the ice flakes off the drum. The knife extends full length of the drum and is downwardly inclined away from the drum and extends outside the housing for the machine, thereby to serve as a chute to direct the ice flakes from the surface of the drum to a point outside the housing. The knife blade is mounted for vertical swinging movement about a horizontal axis parallel to the axis of the drum and is spring-urged against the drum. A supply chamber for water to be frozen, which serves also to collect water falling from the drum, is subdivided by vertical baffles having openings through their lower portion by which the subdivisions intercommunicate.

5 Claims, 3 Drawing Figures

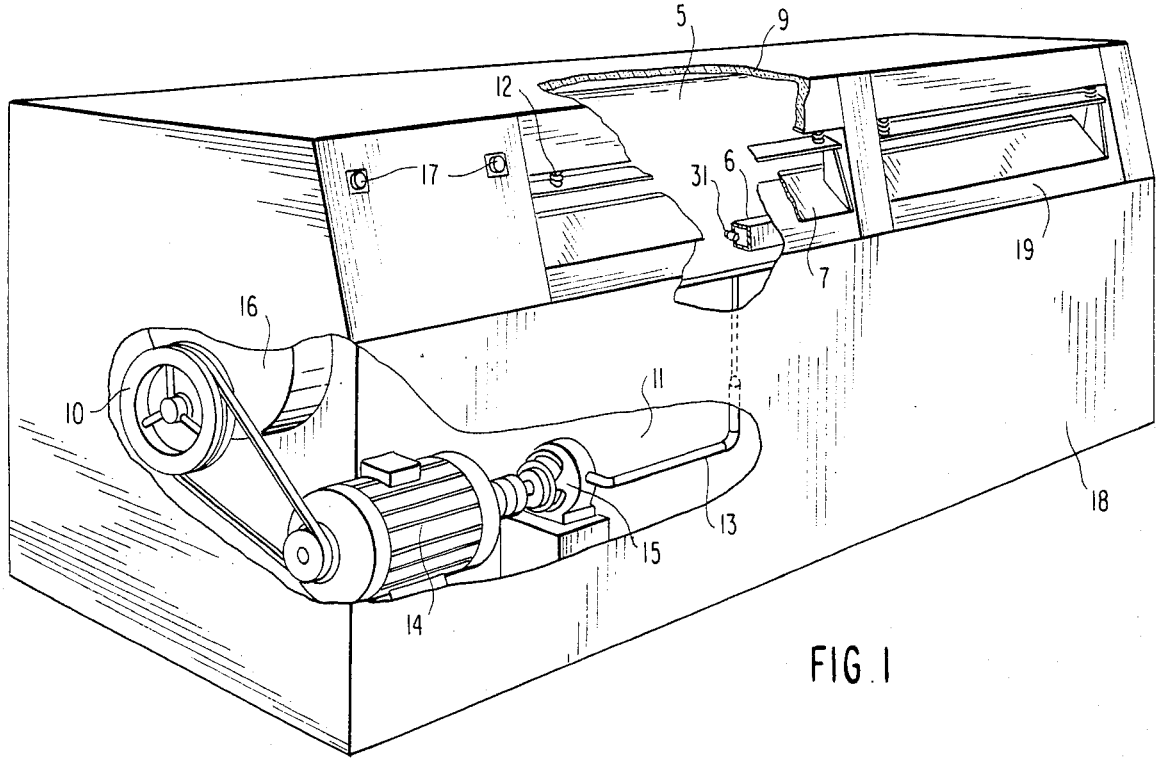
FIG. 1
FIG. 2
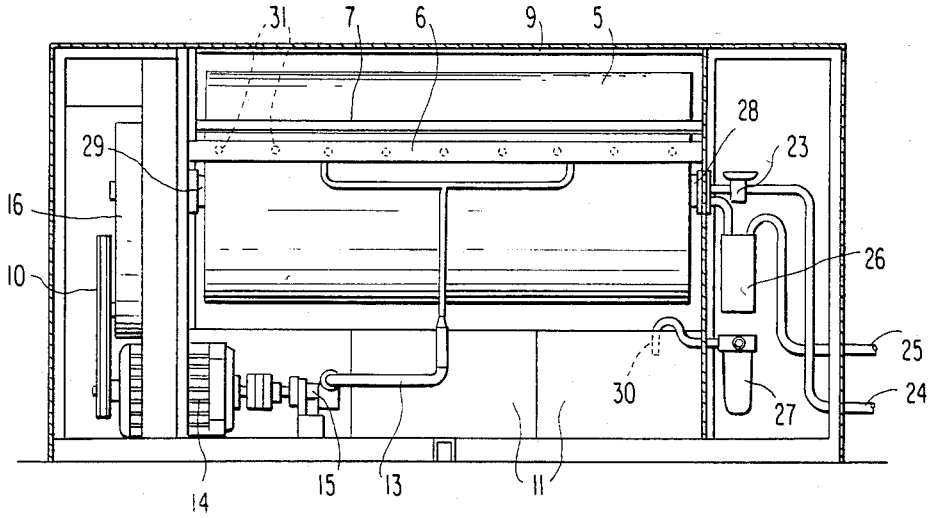

MACHINE FOR MAKING ICE FLAKES FROM SEA WATER OR FRESH WATER

The present invention relates to machines to produce ice flakes from sea water or fresh water.

It is an object of this invention to provide such a machine, adapted to perform a uniform, continuous and much more profitable production of ice flakes, for use, preferably, onboard fishing ships. However, the ice flakes produced by the machine of the present invention are useful in a number of other environments.

Briefly, the present invention achieves this object, by providing such a machine comprising a freezer drum cooled by mechanical refrigeration. Nozzles spray the water onto the freezer drum, on whose surface the water freezes. As the nozzles inject the water under pressure and in a controlled amount no more than that necessary to produce the ice flakes, there results a homogeneous and continuous layer or film of ice over the entire surface of the freezer drum. This layer is not affected by the rocking and other movements of the ship in any direction, no matter what their intensity.

Only a small torque is needed to drive the drum; and the machine in its totality can be driven by a 1-h.p. electric motor which also actuates a sea water or fresh water pump to provide to the nozzles under pressure the water to be frozen. Such a motor can be conventional.

A standard compressor as used in closed refrigeration cycles, can be provided. In such a compressor, gas under high pressure is sent to a condenser for liquefaction, and, via an expansion valve, reaches the evaporator where cold is consumed upon evaporation of the liquid. The resulting vapor is then aspirated by the compressor to repeat the cycle. The compressor can be driven by a conventional electric motor of 3- or 4-h.p.

Other objects, features and advantages of the present invention will become apparent from a consideration of the following description, taken in connection with the accompanying drawings, in which:

FIG. 1 is a perspective view, with parts broken away, of a machine according to the present invention;

FIG. 2 is a side elevational view thereof with the cover removed; and

Figure 3:
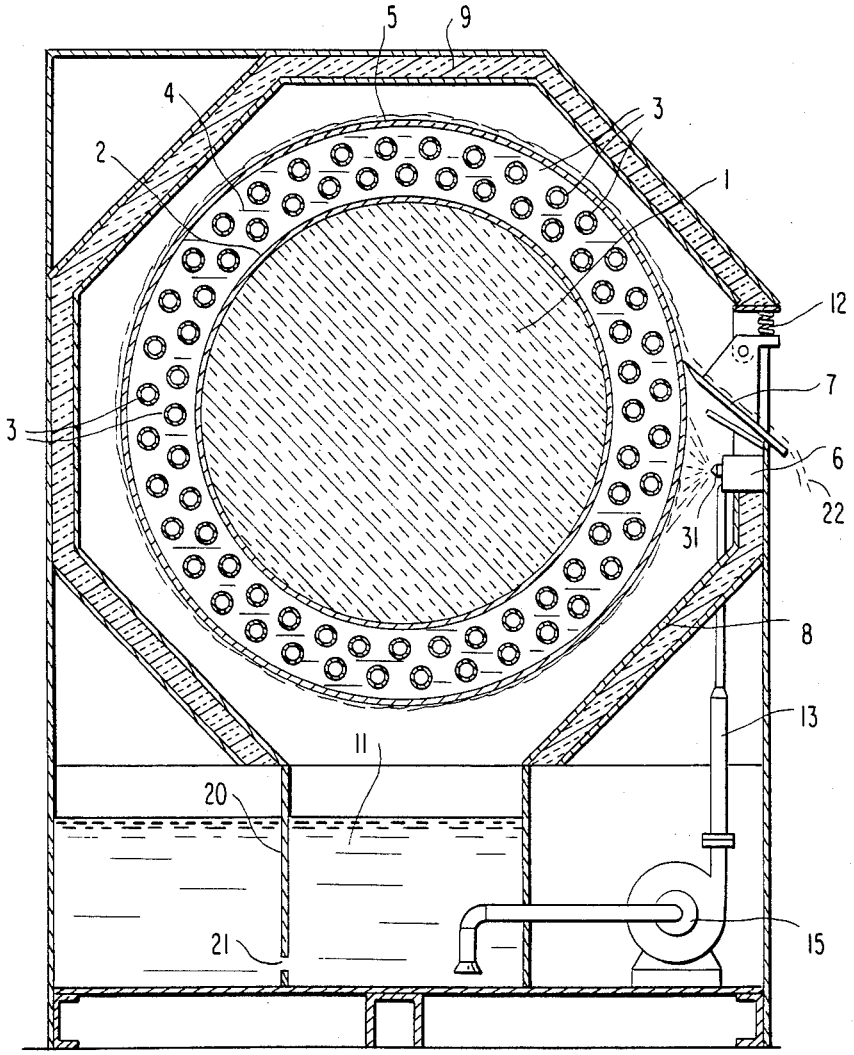
FIG. 3 is a transverse cross-sectional view thereof on an enlarged scale.

Referring now to the drawings in greater detail, there is shown a machine according to the present invention in which a central core comprising a body 1 of insulation surrounded by a cylindrical support 2, is surrounded by evaporator coils 3 supported on the core. Anti-freeze 4 with a glycol base and a very low freezing point surrounds support 2 and fills the space between evaporator coils 3 and is in turn surrounded and retained by an ice-making drum 5. Drum 5, and preferably also support 2, are of metal; and at least drum 5 has a high coefficient of heat transfer.

A nozzle manifold 6 extends full length of and parallel to and is spaced from drum 5. Immediately superposed above manifold 6 is a knife 7, by which ice flakes are scraped from the surface of drum 5 and slide diagonally downwardly over knife 7 and out of the machine through a side wall of insulated housing 8 whose insulation is shown at 9. A flywheel 10 tends to maintain uniform the drive from motor 1.

A water supply tank 11 is provided, for water to be frozen. Tank 11 also catches water falling from the drum which fails to be frozen but which is very cold.

Coil compression springs 12 urge knife 7 counterclockwise as shown in FIG. 3 thereby to cause knife 7 to bear more heavily upon drum 5. The force of springs 12 is adjustable as desired.

Water to be frozen is supplied to manifold 6 via conduit 13. Powered by motor 14 is a water injection pump 15 that feeds conduit 13 at least in part from tank 11. A drum rotation reducer is provided at 16, and start and stop buttons are shown at 17. Outside cover 18 is both decorative and protective.

At the right of FIGS. 1 and 3 is shown the output window 19 for ice produced by the machine of the present invention in the form of flakes. At 20 are shown separator and anti-wave partitions, which define separate water compartments that communicate with each other through orifices 21 adjacent the lowest part of the machine.

There is shown at 22 ice produced by the machine of the present invention, falling outside the cover and hence adapted to be collected and used as desired.

The refrigeration cycle is perhaps best shown in FIG. 2, to comprise an expansion valve 23, a Freon inlet 24, a Freon outlet 25, a liquid Freon separator 26, a water supply intake filter 27, and a hollow shaft 28 that supports drum 5 at one end thereof. A drive coupling shaft 29 applies torque from reducer 16 to drum 5 at the other end thereof.

Finally, water to be sprayed is conducted from a filtered water intake 30 to manifold 6, whence it proceeds to the multiplicity of spray nozzles 31.

In operation, the start push button 17 is pressed to start the operation of the machine, causing current to be supplied to the entire system. The compressor begins to pump the gas, which proceeds from inlet 24 to expansion valve 23, and then by hollow shaft 28 to evaporator coils 3 which are mounted on the cylindrical support 2. This support is thermally insulated on the inside, by insulation 1, to keep the ambient condensation from forming ice.

The members inside drum 5 are stationary, namely, the insulation 1, cylindrical support 2, and evaporator coils 3. By contrast, drum 5 freely and independently rotates on shafts 38 and 29 concentrically of this group of elements and produces a homogeneous and continuous layer or film of ice on its outer surface. As a result of the effect of thermal transmission from the refrigerant to drum 5, and of course ultimately to evaporator coils 3 through antifreeze 4.

As indicated above, drum 5 has, at its end opposite that through which the various conduits described above enter the hollow shaft 28, a drive coupling shaft 29 that receives the drive from the reducer 16 and which in turn is driven by electric motor 14 connected to the chassis which is in the form of a sturdy metal frame. This drive turns drum 5 at about 1 rpm. On both of the shafts 28 and 29, this drum has a system of O-rings to achieve a total and perfect fluidtightness to keep the anti-freeze 4 from leaking or pouring out.

To supply water to the machine for ice making, the water is passed through a filter 27 by which solids are removed. Filtered water is introduced into supply tank 11 in which anti-wave divider and separator partitions 20 are provided, which define separate water compartments that intercommunicate through orifices 21 in their lower part. The partitions divide the tank into anti-wave compartments, thus preventing the pounding of the sea and the rocking of the ship from making the water overflow and flood the machine on the inside whereby the ice-making function of the drum 5 would be substantially impaired.

The filtered water reaches supply tank 11 by intakes 30, which, by a conventional electrical system (not shown), control the water level in the tank and keep it at a volume of about 100 lit. or tank capacity, at a low constant temperature, whereby this body of water performs the function of a heat exchanger.

From tank 11, pump 15 draws the needed water, and, driven by the same main electric motor 14 of the entire system, injects this water through pipes 13 to the manifold 6 at a pressure of, say, 1 kg/cm$^2$. The nozzles 31, fed by manifold 6, then spray the water onto the ice-making drum 5, on which, as already described, a homogeneous, continuous ice layer or film is produced and formed which hardens on the surface of the drum throughout the 350° rotation of the drum between the nozzles and the knife 7.

The knife 7 is yieldably urged against drum 5 by pivotally mounting knife 7 for vertical swinging movement about a horizontal axis, and then urging the knife clockwise as seen in FIG. 3 against the surface of the drum by means of coil compression springs 12. In this way, if there is an excess layer of ice that is not removed by the knife 7, then the knife is free to ride over this excess and then return to the surface of the drum.

It is particularly to be noted that the knife 7 is disposed horizontally and parallel to the axis of drum 5, and covers the entire length of drum 5. The inclination of knife 7 not only permits ready removal of the ice from the drum, but also provides a chute down which the removed ice flakes can slide until they fall outside the device into a suitable receptacle (not shown).

The ice-making drum 5 is surrounded by the insulating frame 8 having internal insulation 9 to prevent temperature losses or fluctuations in the refrigeration chamber, which, besides interfering with correct ice-making, would give rise to unnecessary energy losses.

To avoid liquid hammer in the compressor, the machine is equipped with a liquid Freon separator 26 which is connected to the compressor by the outlet pipe 25.

Once the operation of ice-making is completed, the other button 17 is pressed to stop the operation of the machine.

From a consideration of the foregoing disclosure, therefore, it will be evident that the initially recited object of the present invention has been achieved.

Although the present invention has been described and illustrated in connection with a preferred embodiment, it is to be understood that modifications and variations may be resorted to without departing from the spirit of the invention as those skilled in this art will readilly understand. Such modifications and variations are considered to be within the purview and scope of the present invention as defined by the appended claims.

What is claimed is:

1. A machine comprising means for making ice flakes by freezing water onboard a ship, including a drum rotatable about a horizontal axis, means to cool the drum to below the freezing point of water, means to spray water on the drum, means to collect water falling from the drum, means to supply to said collecting means make-up water to be frozen, said collecting means comprising a plurality of tanks having at least one vertical divider partition therein, and an opening through a lower portion of the divider partition through which the tanks communiate with each other.

2. A machine as claimed in claim 1, said collecting means being the sole source of water supplied to said spray means.

3. A machine comprising means for making ice flakes by freezing water onboard a ship, including a horizontal rotatable drum, spraying means for spraying liquid water on the drum, means to cool the inner surface of the drum to below the freezing point of the water thereby to form ice on the surface of the drum, knife means disposed above the spraying means for removing ice flakes from the drum after the sprayed water has passed through almost one complete revolution about the axis of the drum and is frozen on the surface of the drum, said knife means being inclined downwardly away from the drum, the machine having a housing, the knife means extending from the drum to a point outside the housing to serve as a chute to direct ice flakes to a point outside the housing, means mounting the knife means for vertical swinging movement about a horizontal axis parallel to the axis of the drum, and spring means urging the knife means to swing about said horizontal axis into yieldable contact with the surface of the drum.

4. A machine comprising means for making ice flakes by freezing water onboard a ship, including a fixed horizontal cylindrical core, a hollow cylindrical drum concentric with and spaced outwardly from and rotatable about its axis relative to the core, a plurality of fixed pipes disposed between the core and the drum, means to circulate refrigerant through the pipes, antifreeze liquid with a freezing point lower than that of water substantially filling the space between the core and the drum, means to spray water on the outside of the drum, and means to scrape ice off the surface of the drum.

5. A machine as claimed in claim 3, said spraying means comprising a horizontal manifold for water to be sprayed, and a horizontal series of spaced spray nozzles carried by the manifold and directed toward the outer surface of the rotatable drum.

* * * * *